US005740942A

United States Patent [19]

Araujo, Jr.

[11] Patent Number: 5,740,942

[45] Date of Patent: Apr. 21, 1998

[54] COLLAPSIBLE CONTAINER

[76] Inventor: Jess J. Araujo, Jr., 2530 Greenbrier, Santa Ana, Calif. 92706

[21] Appl. No.: 743,010

[22] Filed: Nov. 1, 1996

[51] Int. Cl.[6] ..... A65D 6/16

[52] U.S. Cl. ..... 220/666; 220/461; 220/462

[58] Field of Search ..... 220/666, 669, 220/6, 907, 419, 460, 461, 462; 215/900, 382; 229/117.01, 117.07

[56] References Cited

U.S. PATENT DOCUMENTS

| | | | |
|---|---|---|---|
| 1,133,050 | 3/1915 | Mearkle | 220/666 |
| 3,354,924 | 11/1967 | Birrell et al. | 220/666 |
| 5,174,458 | 12/1992 | Segati | 220/666 |
| 5,207,250 | 5/1993 | Tsao | 220/666 |
| 5,255,808 | 10/1993 | Tobler | 220/666 |
| 5,524,789 | 6/1996 | Jackman | 220/666 |

*Primary Examiner*—Joseph M. Moy

[57] ABSTRACT

The present invention relates to a new and improved collapsible container for use in transporting and dispensing fluids, primarily gasoline. In its broadest context, the present invention includes a flexible liner with at least three sides. Furthermore, metallic reinforcing walls are secured to at least two of these walls. Due to the material characteristics of the reinforcing walls, specifically a memory steel, a spring force is created which tends to urge the reinforcing walls inwardly. However, the presence of a fluid within the container overcomes this spring force and keeps the container in its non-collapsed or opened configuration.

4 Claims, 3 Drawing Sheets

COLLAPSIBLE CONTAINER

BACKGROUND OF THE INVENTION

1. Field of the Invention

The present invention relates to a collapsible container for use in transporting and dispensing fluids, primarily gasoline, and more particularly pertains to a collapsible container with a flexible liner.

2. Description of the Prior Art

The use of containers is known in the prior art. More specifically, containers heretofore devised and utilized for the purpose of holding and dispensing fluids are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,083,678 to Waring; U.S. Pat. No. 3,946,903 to Parker; U.S. Pat. No. 4,264,018 to Warren; U.S. Pat. No. 4,378,069 to Franco; U.S. Pat. No. 5,226,574 to Durinzi, Jr. all relate to various containers.

In this respect, the collapsible container according to the present invention substantially departs from the conventional concepts and designs of the prior art, and in doing so provides an apparatus primarily developed for the purpose of holding and dispensing fluids, primarily gasoline.

Therefore, it can be appreciated that there exists a continuing need for new and improved collapsible container which can be used for holding and dispensing fluids, primarily gasoline. In this regard, the present invention substantially fulfills this need.

SUMMARY OF THE INVENTION

In view of the foregoing disadvantages inherent in the known types of containers now present in the prior art, the present invention provides an improved collapsible container. As such, the general purpose of the present invention, which will be described subsequently in greater detail, is to provide a new and improved collapsible container and method which has all the advantages of the prior art and none of the disadvantages.

To attain this, the present invention essentially comprises a collapsible container. The container includes a flexible liner constructed from a synthetic material. The liner comprises a first, second and third rectangular wall. Each of these walls has a pair of major edges and an upper minor edge and a lower minor edge. All the of rectangular walls are joined to one another along the major edges. The liner further comprises an upper triangular wall and a lower triangular wall, with the upper triangular wall being joined to the upper minor edges of the rectangular walls. The lower triangular wall is joined to the lower minor edges of the rectangular walls. A threaded aperture is formed through the upper triangular wall. A first metallic rectangular wall having a first major edge, a second major edge, an upper minor edge, lower minor edge, an interior surface, and an exterior surface, a handle formed upon the upper minor edge, has its interior surface secured to the first rectangular wall of the flexible liner. A second metallic rectangular wall having a first major edge, a second major edge, an upper minor edge, a lower minor edge, an interior surface, and an exterior surface, a handle formed upon the upper minor edge, has its interior surface secured to the second rectangular wall of the flexible liner. The first major edge of the first metallic rectangular wall and the first major edge of the second metallic rectangular wall are joined to one another and define a primary hinge. Due to the material characteristics of the metallic rectangular walls the primary hinge functions to urge the first and second rectangular walls towards one another. A carry strap having a first end and a second end and an intermediate extent therebetween, has its first end secured to the handle of the first metallic rectangular wall, and its second end secured to the handle of the second metallic rectangular wall. A pouring spout defined by a first extent and a second extent, with the second extent being positioned ninety degrees relative to the first extent, the first extent is a threaded end which is adapted to be removably secured within the threaded aperture of the upper triangular wall.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible container which has all the advantages of the prior art containers and none of the disadvantages.

It is another object of the present invention to provide a new and improved collapsible container which may be easily and efficiently manufactured and marketed.

It is further object of the present invention to provide a new and improved collapsible container which is of durable and reliable constructions.

An even further object of the present invention is to provide a new and improved collapsible container which is susceptible of a low cost of manufacture with regard to both materials and labor, and which accordingly is then susceptible of low prices of sale to the consuming public, thereby making such collapsible container economically available to the buying public.

Even still another object of the present invention is to provide a collapsible container which has a small collapsed configuration.

Lastly, it is an object of the present invention to provide a new and improved collapsible container for use in transporting and dispensing fluids, primarily gasoline. In its broadest context, the present invention includes a flexible liner with at least three sides. Furthermore, metallic reinforcing walls are secured to at least two of these walls. Due to the material characteristics of the reinforcing walls, specifically a memory steel, a spring force is created which tends to urge the reinforcing walls inwardly. However, the presence of a fluid within the container overcomes this spring force and keeps the container in its non collapsed or opened configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
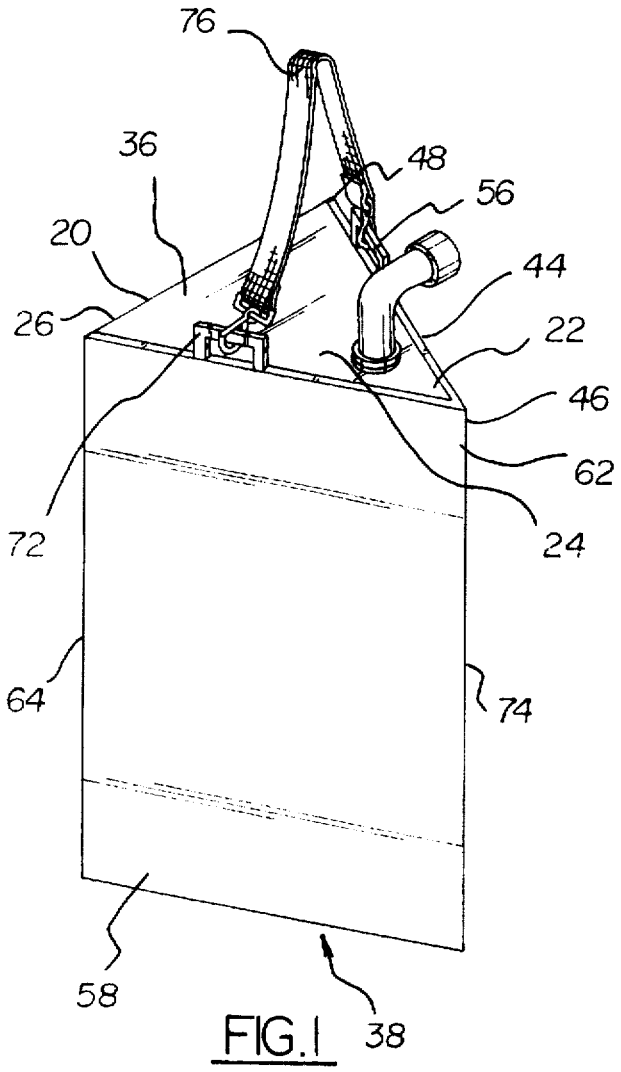
FIG. 1 is a perspective view of the preferred embodiment of the collapsible container constructed in accordance with the principles of the present invention.
Figure 2:
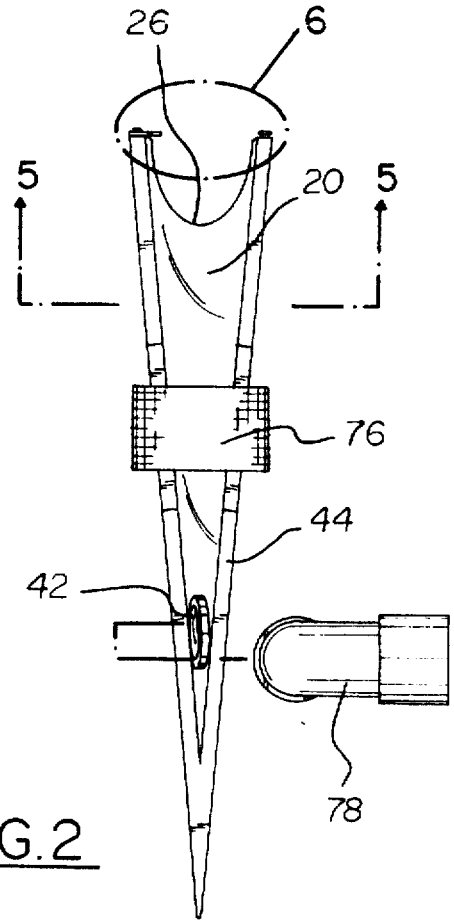
FIG. 2 is a plan view of the preferred embodiment of the container of the present invention.
Figure 3:
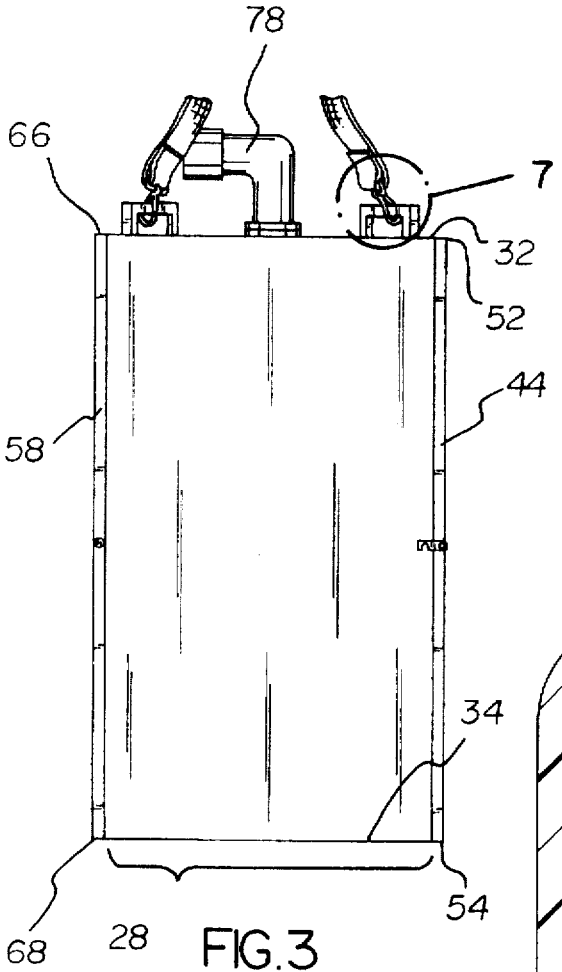
FIG. 3 is a side view of the container in accordance with the present invention.
Figure 4:
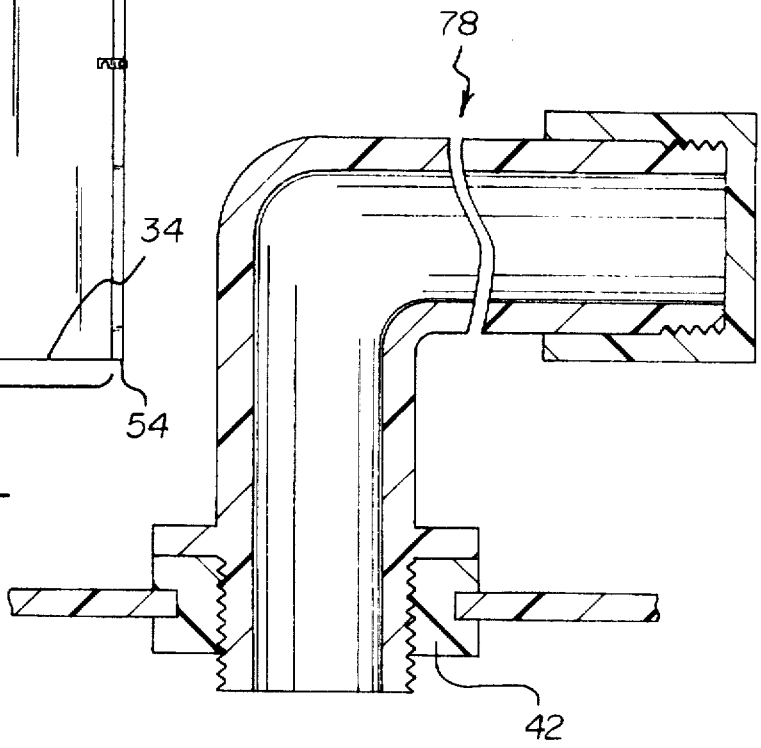
FIG. 4 is a sectional view of the spout employed with the present invention.
Figure 5:
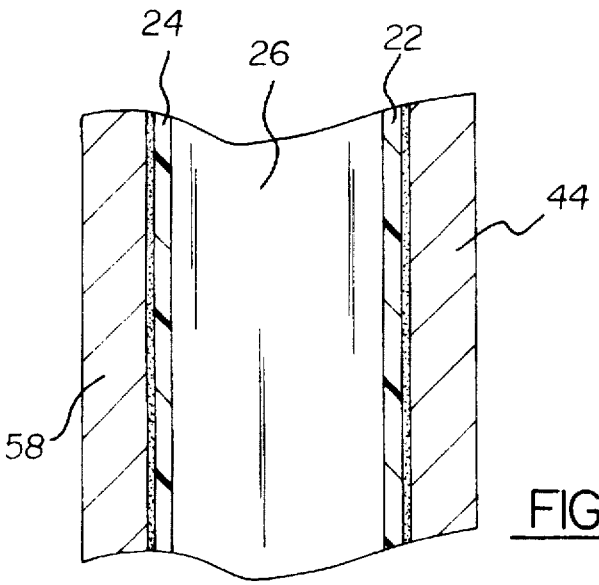
FIG. 5 is a view taken along line 5—5 of FIG. 2.
Figure 6:
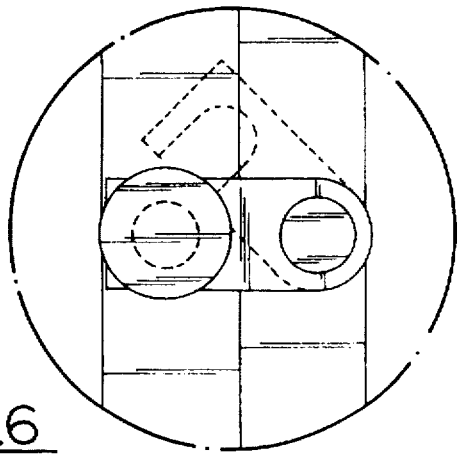
FIG. 6 is an expanded view of the latch in accordance with the present invention.
Figure 7:
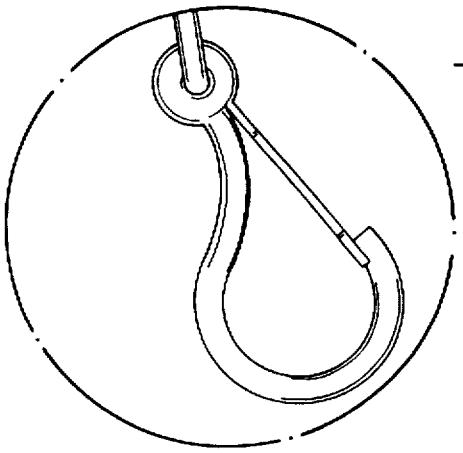
FIG. 7 is an expanded view of one end of the carry strap employed with the present invention.

With reference now to the drawings, and in particular to FIG. 1 thereof, the preferred embodiment of the new and improved collapsible container embodying the principles and concepts of the present invention and generally designated by the reference numeral 10 will be described.

The present invention relates to a new and improved collapsible container for use in transporting and dispensing fluids, primarily gasoline. In its broadest context, the present invention includes a flexible liner with at least three sides. Furthermore, metallic reinforcing walls are secured to at least two of these walls. Due to the material characteristics of the reinforcing walls, specifically a memory steel, a spring force is created which tends to urge the reinforcing walls inwardly. However, the presence of a fluid within the container overcomes this spring force and keeps the container in its non collapsed or opened configuration. The details of the components of the present invention, and the manner in which they interrelate, will be described in greater detail hereinafter.

The container employs a flexible liner 20 constructed from a synthetic material. This liner 20 is defined by a first, second and third rectangular wall 26. In turn, each of the walls is defined by a pair of major edges 28 and an upper minor edge 32 and a lower minor edge 34. All of these rectangular walls are joined to one another along the major edges. The liner 20 is further defined by an upper triangular wall and a lower triangular wall 38. The upper triangular wall is joined to the upper minor edges of the rectangular walls, likewise the lower triangular wall 38 is joined to the lower minor edges of the rectangular walls. A threaded aperture 42 is formed through the upper triangular wall. This aperture can either be formed within the liner 20, or alternatively formed within a reinforcing sheet which is positioned within the liner 20. Thus, what has been defined is a five sided liner 20 member which is integrally formed and has a triangular cross section.

The preferred embodiment of the present invention employs two metallic rectangular walls. The first metallic rectangular wall 44 is defined by a first major edge 46, a second major edge 48, an upper minor edge 52, lower minor edge 54, an interior surface, and an exterior surface. Additionally, a handle 56 is formed upon the upper minor edge 52. The interior surface of the rectangular wall is secured to the first rectangular wall 22 of the flexible liner 20. This securement can be achieved in any number of ways, however, an adhesive is preferred.

Likewise, the second metallic rectangular wall 58 is defined by a first major edge 62, a second major edge 64, an upper minor edge 66, a lower minor edge 68, an interior surface, and an exterior surface. Again, a handle 72 is formed upon the upper minor edge 66. The interior surface of this rectangular wall is secured to the second rectangular wall 24 of the flexible liner 20. The attachment is achieved in the same manner as the attachment between the first rectangular wall and the first rectangular wall 22 of the liner 20. The first major edge 46 of the first metallic rectangular wall 44 and the first major edge of the second metallic rectangular wall 58 are joined to one another and together define a primary hinge 74. Due to the material characteristics of the metallic rectangular walls the primary hinge 74 functions to urge the first and second rectangular walls towards one another. More specifically, the metallic rectangular walls are constructed from a memory steel which tends to urge the two metallic rectangular walls into facing relation. However, the spring type tension which is created within the primary hinge 74 can be overcome by the presence of a fluid within the liner 20.

A carry strap 76, which is defined by a first end and a second end and an intermediate extent therebetween, can be employed in carrying the container of the present invention. In employing this strap 76, the first end is secured to the handle of the first metallic rectangular wall 44, while the second end is secured to the handle of the second metallic rectangular wall 58. This securement can take place by ways of clips.

Additionally, a pouring spout 78, defined by a first extent and a second extent, can be employed in pouring liquids which are stored within the container. In the preferred embodiment, the second extent of the spout is positioned ninety degrees relative to the first extent. The first extent has a threaded end which is adapted to be removably secured within the threaded aperture 42 of the upper triangular wall 36. Thus, the pouring spout 78 can be removed, and a threaded cap placed thereon, when an operator does not wish to pour fluids.

In order to facilitate the transportation of the container when it is in its collapsed configuration, a fastening means can be employed. More specifically, a pivotal latch can be secured to the edge of the first metallic rectangular wall 44 opposite the primary hinge 74. Additionally, a pin can be secured to the edge of the second metallic rectangular wall 58 opposite the primary hinge 74. Thus, when the container is in its collapsed configuration, namely the two metallic walls are in facing relation, the latch can be positioned over the pin to ensure that the metallic walls do not move apart.

In operation, a user first utilizing the container would find it in its collapsed configuration. Namely, the two metallic walls would be in facing relation. The force of the primary hinge 74, specifically the edge joining the two metallic walls, acts to keep the container in its collapsed configuration. In this configuration, the resilient synthetic liner 20 would be positioned between the two metallic walls. Furthermore, the third wall of the liner 20 would be folded positioned between the two metallic walls. Any openings formed within the upper triangular wall of the liner 20 would be rotated 90 degrees. This rotation is due to the flexible nature of the liner 20, and permits the container to come to its collapsed configuration. When fluid is introduced into the liner 20 it expands and overcomes the spring force of the primary hinge 74. Thus, the metallic walls move outwardly out of facing relation. The angle formed by the two metallic walls depends upon the volume and density of fluid placed within the liner 20. No fluid within the liner 20 results in an angle of zero degrees, or facing relation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved collapsible container, the container comprising in combination, a flexible liner constructed from a synthetic material, the liner comprising a first, second and third rectangular wall, each of the walls having a pair of major edges and an upper minor edge and a lower minor edge, all the of rectangular walls being joined to one another along the major edges, the liner further comprising an upper triangular wall and a lower triangular wall, the upper triangular wall being joined to the upper minor edges of the rectangular walls, the lower triangular wall being joined to the lower minor edges of the rectangular walls, a threaded aperture formed through the upper triangular wall;

a first metallic rectangular wall having a first major edge, a second major edge, an upper minor edge, lower minor edge, an interior surface, and an exterior surface, a handle formed upon the upper minor edge, the interior surface secured to the first rectangular wall of the flexible liner;

a second metallic rectangular wall having a first major edge, a second major edge, an upper minor edge, a lower minor edge, an interior surface, and an exterior surface, a handle formed upon the upper minor edge, the interior surface secured to the second rectangular wall of the flexible liner, the first major edge of the first metallic rectangular wall and the first major edge of the second metallic rectangular wall being joined to one another and defining a primary hinge, due to the material characteristics of the metallic rectangular walls the primary hinge functioning to urge the first and second rectangular walls towards one another;

a carry strap having a first end and a second end and an intermediate extent therebetween, the first end secured to the handle of the first metallic rectangular wall, the second end secured to the handle of the second metallic rectangular wall; and a pouring spout having a first extent and a second extent, with the second extent being positioned ninety degrees relative to the first extent, the first extent having a threaded end which is adapted to be removably secured within the threaded aperture of the upper triangular wall.

2. A collapsible container, the container comprising:

a flexible liner comprising a first, second and third rectangular wall, each of the walls having a pair of major edges and an upper minor edge and a lower minor edge, all the of rectangular walls being joined to one another along the major edges, the liner further comprising an upper triangular wall and a lower triangular wall, the upper triangular wall being joined to the upper minor edges of the rectangular walls, the lower triangular wall being joined to the lower minor edges of the rectangular walls;

a first metallic rectangular wall having a first major edge, a second major edge, an upper minor edge, lower minor edge, an interior surface, and an exterior surface, the interior surface secured to the first rectangular wall of the flexible liner; and a second metallic rectangular wall having a first major edge, a second major edge, an upper minor edge, a lower minor edge, an interior surface, and an exterior surface, the interior surface secured to the second rectangular wall of the flexible liner, the first major edge of the first metallic rectangular wall and the first major edge of the second metallic rectangular wall being joined to one another and defining a primary hinge, due to the material characteristics of the metallic rectangular walls the primary hinge functions to urge the first and second rectangular walls towards one another.

3. The container as described in claim 2 further comprising;

a handle positioned upon the upper minor edge of the first metallic rectangular wall, a handle positioned upon the upper minor edge of the second metallic rectangular wall; and a carry strap having a first end and a second end and an intermediate extent therebetween, the first end secured to the handle of the first metallic rectangular wall, the second end secured to the handle of the second metallic rectangular wall.

4. The container as described in claim 2 further comprising:

a threaded aperture formed within the upper triangular wall; and a pouring spout having a first extent and a second extent, with the second extent being positioned ninety degrees relative to the first extent, the first extent having a threaded end which is adapted to be removably secured within the threaded aperture of the upper triangular wall.

* * * * *